US006158143A

United States Patent [19]

Da Cunha

[11] Patent Number: 6,158,143

[45] Date of Patent: Dec. 12, 2000

[54] GRAIN DRYER IN CROSS OBLIQUE FLOW

[75] Inventor: Otalicio Pacheco Da Cunha, Sao Leopoldo, Brazil

[73] Assignee: Dryexcel Mautencao de Equipamentos e Comercial Ltda., Sao Leopoldo, Brazil

[21] Appl. No.: 09/200,293

[22] Filed: Nov. 25, 1998

[30] Foreign Application Priority Data

Nov. 26, 1997 [BR] Brazil ..... 9705550

[51] Int. Cl.[7] ..... F26B 17/12

[52] U.S. Cl. ..... 34/167; 34/171; 34/178

[58] Field of Search ..... 34/165, 167, 169, 34/170, 171, 172, 173, 178; 432/14, 17, 96, 101; 366/341

[56] References Cited

U.S. PATENT DOCUMENTS

| | | | |
|---|---|---|---|
| 1,716,876 | 6/1929 | Chamberlain | 34/167 |
| 2,552,063 | 5/1951 | Robinson | 34/167 |
| 3,739,493 | 6/1973 | Nivon | 34/167 |
| 4,255,130 | 3/1981 | Johnson, Jr. | 34/171 X |
| 4,423,557 | 1/1984 | Westelaken | 34/167 X |
| 4,486,960 | 12/1984 | Maurice et al. | 34/169 |

*Primary Examiner*—Stephen Gravini
*Attorney, Agent, or Firm*—Hughes Hubbard & Reed LLP; Ronald Abramson; Peter A. Sullivan

[57] ABSTRACT

A grain dryer has three levels of modulated air chambers; a multi-perforated chamber holding grains which surround all three levels of the modulated air chambers; an intermediate air passage; partition walls and a set of central fans to direct airflow cross-upwardly in an S-shape inside the grain dryer; and an external chamber to exhaust air out to the ambient, minimizing heat loss, and thereby increasing the effiency of moisture exhange between grains and air.

3 Claims, 1 Drawing Sheet

GRAIN DRYER IN CROSS OBLIQUE FLOW

SECTOR OF INVENTION

The present invention refers, in a general sense, to the technological sector or processes and equipment for drying grain, and in a special way, to the special form of a grain dryer in cross oblique flow, with the aim to achieve a special ecological procedure and equipment, of drying grain by the non-liberation of saturated air into the environment and also in order to present among other advantages, a high thermic return, compared to the conventional manners. It's main characteristic lies in the fact that the hot air flow in relation to the vertical down-flow of the mass of grains, goes upward in form of an "S"—cross oblique flow—crossing the mass of grain several times, using the heat of the drying air to its maximum.

In reality, the present patent aims at a special form of drying grain in a cross oblique flow, projected in a careful way with the intention to characterize something really new and able to occupy a place of superiority when compared to the characteristics of the conventional forms which belong to this technological sector.

STATE OF KNOWN TECHNIQUE

One knows, that the drying of grain aims at the withdrawel of some of the water contained in agricultural products, defined as a transfer process of heat and mass between the product and the air of drying.

The withdrawel of humidity must be done in such a way that the product stays in equilibrium with the air of the environment, where it will be stocked, in order to maintain its appearance and nutritional quality or for being used as seed.

The importance of drying agricultural products increases with the population growth, due to the possibility of anticipating crops and stocking for long time periods, without the danger of deterioration of the product.; the maintainance of germinating power during long periods of time; in order to prevent the development of micro-organisms and insects and, also, due to the minimization of losses of the product in the field.

One also knows, that, during drying, the withdrawel of humidity is obtained by moving the water, due to a difference of pression of the water's vapour between the surface of the product to be dryed and the air which involves it. Therefore the most used method of drying is that which uses counter-currents by which the grains to be dryed and the heated air flow of drying move in the same direction, but counter-clockwise.

Among those modern equipment in the technological area, we want to mention that made by Grain Systems (INC. (GSI), an American enterprise, known as "GSI TOWER DRYER", which contains a tower like structure, in the inner part of which is a chamber for passing the grain and on the outer part an air heating chamber (in crossway flow), which, in an inferior manner, collects the air of the environment, enters the grain mass, cooling it and pre-heating the air, later being heated (by the internal central heater) which leads this heated air flow into the mass of grain and from there to the external environment.

In praxis, data refering to drying by equal or similar equipment as described above, have been observed abd collected. The results of operational and functional performance are dubious.

Among the disadvantages of these equipment we should mentions, among many others, the low thermical performance presented; the high consumption of energy: the overheating of the grains at the entrance of the dryer; the non-uniformity of the drying; and, also the very low quality of the product, refering to aspect and the nutritional quality for animal and/or human feeding, as well as the viability of being used as seeds.

It happens that, in the conventional equipment and based on the hygrosopical characteristics of the grain to be dryed, those grains with a high humidity content (coming from the fields), immediatedly at the entrance of the dryer a hot air flow for drying, with high temperature, is received, which leads to an over-heating of the grains and which continues along their passing through the interior of the dryer, causing irreparable damage to their chemical, physical, and biological qualitites.

Besides the above mentioned data, information was received by publication of Sep. 16, 1997 (RPI 1393), PI 95016827 (System and disposition of participation of air in tower dryers for vegetable grain) and PI 9501647-7 (Ring-dryer for vegetable grain) filed respectively on Apr. 27, 1995 and May 2, 1995 by Flavio Luis Bueno Hemig (BR/RS).

In synthesis, the system of the participation of air (which is used in the above refered to ring dryer) needs the participation of an air flow for drying in an entrance chamber of the dryer, the first part of this flow passing through the grain flow in a tower and the second part of thedrying air flow passing through the complementary grain tower, so that the respective flows pass the respective columns (towers) of grain in an opposite sense.

The ring-dryer, by itself, presents, in sythesis, a superior drying sector by its internal chamber of higher air, an intermediate drying sector, with an internal suction chamber and an external chamber; and inferior drying sector with an internal air chamber and an external chamber; a sector for cooling with the above mentioned hot air chamber and an external cooling chamber; the fact that the mentioned superior hot air chamber is separated from the mentioned chamber of suction by a plain surface in the center of which is a register (file); the fact that the intermediate drying sector and the respective chamber are separated from the inferior drying sector and the respective chamber by inversal divices of two lateral air flows with relation to a central grain flow.

Those publications also inform that the ring-dryer does a triple grain drying operation, the first one being done in the inner superior sector by means of a total flow stemming of the hot-air chamber; the second one by means of the ASM flow (intermediate drying air) coming from the out—to the inside; and the third one is conducted from the inside to the outside by a ASI flow crossing (inferior drying air).

It is also said that this kind of disposition of the drying air flows permit that the flow of the grain will be homogenously dry, thus increasing the characteristics of the final product.

By analising these facts one notices that those separated flows (inferior) and later joined (superior) in the drying chamber will show a good result, as the register will hardly present a well synchronized operation due to many different aspects (such as constructive, functional and operational).

Besides, due to the superior drying, the dryer sends the air to the external environment, without any kind of treatment, thus contributing to the polution of the external air.

By the above mentioned facts we can see, that the above mentioned facts, besides being an evolution in the technical area, but with respect to the aims of a grain dryer, the references may be considered only for a general interest of the invented scope, object of the present report.

NEWNESS AND AIMS OF THE INVENTION

Therefore we want,with the present invention, to characterize the peculiar form of the grain drayer in an oblique cross flow, which will definitely solve all the presented problems of the conventional similar equipment, guaranteeing the maintanance of the physical chemical and biological quality of the grains after the drying process, also contributing to the preservation of the environment by the non-emission of any type of particle into the same.

The main characteristic of the present grain dryer, as already mentioned, lies in the fact that the hot air flow in relation to the vertical descending flow of the grains, takes an ascending way in form of an "S"—oblique cross flow—which travels several times across the mass of grain, using to utmost advantage the heat provided to the drying air, using all the heat during the "S" flow. At the end of the ascending flow it will be directed to an external chamber of the dryer, furnishing a thermic isolation to the structure of the dryer—by a descending air flow, divergent parallel to isolation.

Such drying procedure of a good thermical performance, is based on the principle that the higher the contents of the mass of grains' humidity (at the entrance of the dryer) the lower will be the temperature of the dryer's air flow. On the vertical descendent way in the inner dryer, when the humidity is getting lower, it will received a drying air flow with a higher temperature.

In other words, the oblique cross flow, here described, atends to what the nature of the grains require, as the mass of grains, when entering the drying structure, receives periods of pre-drying with a low temperature, and while lowering its humidity contents, enters into contact with thedrying air flow, with a higher temperature, which produces the very drying of the mass of grains.

The structure developed for this "S" dryer contains an inferior interior chamber for drying, an intermediate intern chamber for pre-drying and a superior intern chamber for pre-drying all around an external multiperfurated chamber for the grain . . . mass. The inferior chamber and the intermediate chamber are separated physically by a separation plate (or similar), whereas the intermediate and the superior are physically separated by a separation plate with a central group of fans. Outside of the central-inferior grain chamber is a chamber for the passing of the dryers air, between the inferior intern and the intermediate chambers, meanwhile above the superior pre-drying chamber thermic isolation of the structure to conduct the air to the environment (or to any other apropriate place) and also for the diminishing of particles (accumulation due to gravity).

DESCRIPTION OF THE ANEXED PLATES so that the peculiar form of the oblique cross flow grain dryer may be better understood and executed by any specialist in this technical area, it will be clearly defined based on the below listed plates, which represent the best form for executing the dryer, as planned by the present invention.

However, the present form of the grain dryer is not limited to an only way of manufacturing it as there may be other forms of execution by which the form/design of the present invention should not be altered.

So, FIG. 1, the only one presented, shows the squematic frontal and ilustrative view of the oblique cross flow grain dryer, which aims at the fact that the hot air flow related to the descendent vertical flow of the grain mass, goes upward in form of an "S"—oblique cross flow—which crosses the mass of grains several times, using the heat proportioned to the dryers air to its utmost.

Although the present form of the grain dryers is being described and analized with a preference way of manufacturing same it will not be limited to only one way of building it.

On the contrary all kind of alternatives, modifications and equivalents may be used within the scope of this invention.

DETAILED DESCRIPTION OF THE INVENTION

Figure 1:
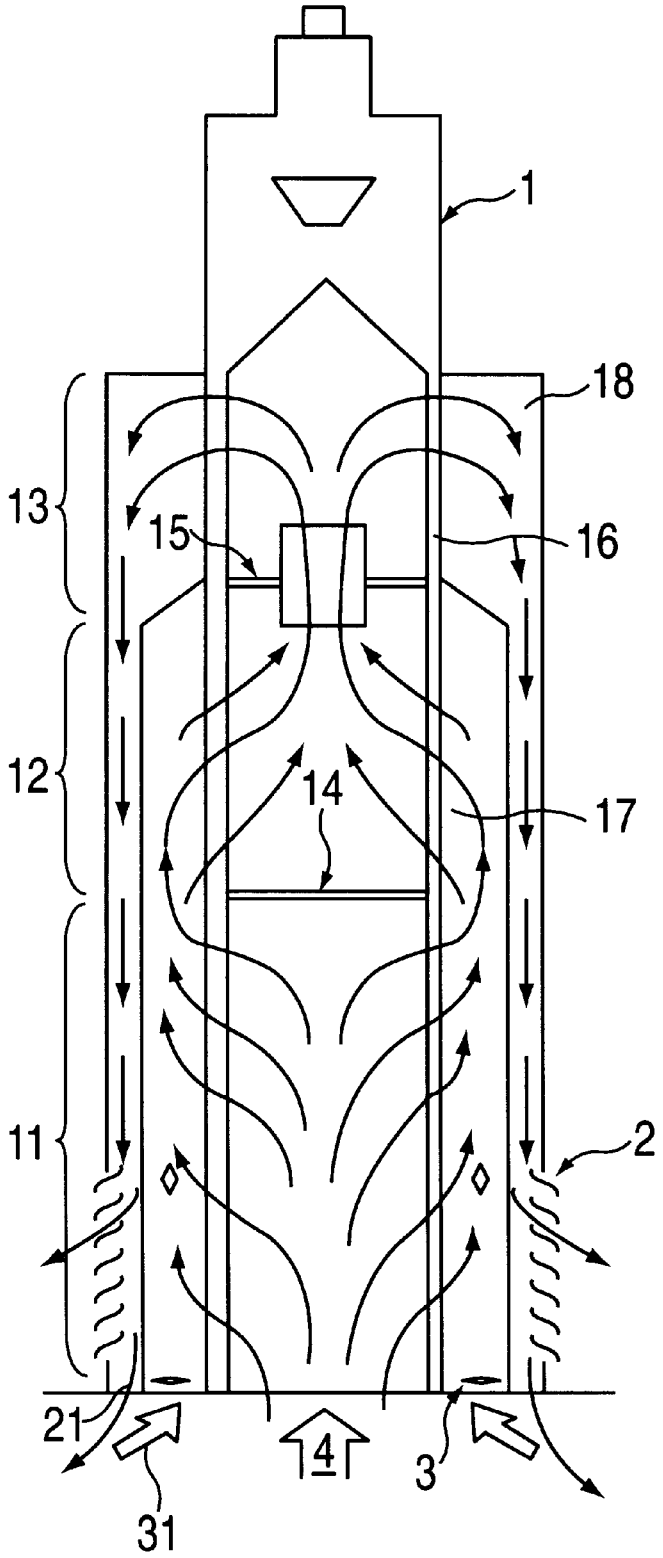

As one can see by analizing the anexed figures, the peculiar form of the oblique cross flow grain dryer is essentially planned to use a certain principle of drying, in which, the higher the humidity of the grain mass is,in a vertical descendent flow, the lower will be the ascendent flow of the dryer's air and vice versa as the air flow in relation to the flow of the grain mass makes its way in an "S" form, crossing the mass of grains several times, sometimes in one, sometimes in the contrary way, giving heat and withdrawing humidity in an oblique ascendent cross flow. At the end of the mentioned "S" way, the air flow will go to the external and concentric part of the structure, furnishing a thermic isolation of the same through a vertical descendent or paralel divergent flow.

The invention also contains a drying structure of an modulated lower level internal drying chamber (11), an modulated middle level internal preheating chamber (12) and a modulated upper level internal preheating chamber (13), the first two ones being separated by horizontal separating plates (14) and the two last ones by a horizontal separating plate with a set of central fans (15) meanwhile all of them are situated around a multi-perforated chamber holding grains (16) around which can be found: an intermediate air passage wherein the heated air is deflected upwardly from this drying chamber (11) to the pre-drying chamber (12), covering them totally; and an external chamber (18) which receives the air flow from the modulated upper level internal preheating chamber (13) and which acts as an insulating layer to minimize heat loss from the preheating and drying chamber.

The grain dryer, hereby presented, is also characterized by the fact that the drying air flow goes below the modulated lower level internal drying chamber (11) being directed, by the "s" form in the interior of the dryer (1) by a set of central fans (15), wherein the set of central fans creates an area of low pressure in the modulated lower level internal drying chamber, causing the heated air to flow upward inside the grain dryer.

The grain dryer, which is here discussed, is also characterized by the fact that the drying air flow, in the interior of the structure (1) works in the "s" form or: cross-upwardly and at the end flows downwardly in the external chamber (18), promoting the drying of the grains and insulating the drying structure (1).

The invention, here describer, is further characterized by the fact that the mentioned external chamber (18), not only acts as an insulating layer to minimize heat loss from the drying structure, but also guides the exhausted air in a downward direction, and enables separation of the particles pulled up by the exhausted air before being carried out the ambient.

The invention,in question, is also characterized by the fact that the air flow of drying, at the end of its way in the interior of the structure (1) may be directed to the external environment by (2) or to any other apropriate site (21)for a future filtering of a transport of the particles, depending on the type of grain processed in the structure (1).

the dryer is also characterized by the fact that, in the intermediate air passage (17) opening/blocking valve (3) are foreseen which, by option, may introduce ambient air into the intermediate air passage (31).

The grain dryer, as to this invention, may present various shapes—circular, square, rectangular, hexagonal or octagonal, besides presenting an intern heat resource. But, preferentially, there should be an external heat source (4) which may use coal. Diesel oil, wood, gas or electric energy.

Alternatively this heat source (4) may also use simply natural air, which consists in a artificially refrigerated air source Finally, the hereby presented grain dryer is also characterized by the fact that the multi-perforated thin chamber holding grains (16) is of homogeneous thickness in all its extension of approximately ⅓ of the thickness of the intermediate passage chamber (17) guaranteing a better result of drying and/or of the change of heat of air/grain.

In the present description of peculiar form of grain dryer in oblique cross flow has been presented, as to the set up analysis, accompanied by the anexed charts about the technical characteristics which assure a distinctive form in relation to everything known in this technological area.

I claim:

1. An oblique cross grain dryer comprising a modulated lower level internal drying chamber, wherein heated air flows upward inside said lower level modulated internal drying chamber; a horizontal plate which separates said modulated lower level internal drying chamber from a modulated middle level internal preheating chamber and which deflects air flow upwardly through a multi-perforated chamber, said perforated chamber passing grains through downwardly and heated air cross-upwardly in an S-shape and said multi-perforated chamber surrounding said modulated lower level internal drying chamber, said modulated middle level preheating chamber and a modulated upper level preheating chamber; an intermediate air passage wherein said heated air from said multi-perforated chamber is deflected upwardly into said modulated middle level internal preheating chamber by passing through said multi-perforated chamber, holding said grains; said modulated upper level internal preheating chamber being separated from said modular middle level internal preheating chamber by a horizontal plate with a set of central fans, wherein said set of central fans creates an area of low pressure in said modulated lower level internal drying chamber causing said heated air to flow upward inside said grain dryer; and an external chamber in which said heated air is exhausted from said modulated upper level internal preheating chamber to the ambient in a downward direction minimizing heat loss from said modulated lower level internal drying chamber, said modulated middle level internal preheating chamber and said modulated upper level internal preheating chambers, and thereby increasing the efficiency of moisture exchange between grains and air.

2. The oblique cross grain dryer of claim 1, wherein said grain dryer further comprises valves to introduce ambient air into said intermediate air passage for more efficient moisture exchange between grains and air.

3. The oblique cross grain dryer of claim 1, wherein said grain dryer further comprises registers to direct solid particles in said exhausted air to a different location.

* * * * *